United States Patent [19]

McCaskill, Jr.

[11] 4,387,514

[45] Jun. 14, 1983

[54] METHOD FOR DRYING OIL WELL DRILL CUTTINGS

[75] Inventor: James N. McCaskill, Jr., Houston, Tex.

[73] Assignee: Dresser Industries, Inc., Dallas, Tex.

[21] Appl. No.: 251,437

[22] Filed: Apr. 6, 1981

[51] Int. Cl.[3] ..... F26B 3/04

[52] U.S. Cl. ..... 34/31; 34/182; 175/206; 208/11 LE

[58] Field of Search ..... 34/164, 57 A, 77, 10, 34/28, 31, 32, 33, 76, 182; 175/66, 206; 208/8, 11 LE

[56] References Cited

U.S. PATENT DOCUMENTS

| | | | |
|---|---|---|---|
| 3,658,015 | 4/1972 | Griffin et al. | 110/7 R |
| 3,693,951 | 9/1972 | Lawhon et al. | 263/8 R |
| 3,768,174 | 10/1973 | Biaggi | 34/164 |
| 4,058,905 | 11/1977 | Knight | 34/15 |
| 4,139,462 | 2/1979 | Sample, Jr. | 210/72 |
| 4,208,285 | 6/1980 | Sample, Jr. | 210/180 |
| 4,209,381 | 6/1980 | Kelly, Jr. | 208/8 LE |
| 4,222,988 | 9/1980 | Barthel | 422/309 |

OTHER PUBLICATIONS

"Is Oil a Threat to Marine EcoSystems?", Houston Engineer, Jun. 1980.

Catalog 1149-3.5 "Dryers and Coolers".

*Primary Examiner*—Larry I. Schwartz

*Attorney, Agent, or Firm*—J. N. Hazelwood; B. E. Deutsch

[57] ABSTRACT

A method for drying oil well drill cuttings to eliminate pollution causing organic material from the cuttings includes conveying the drill cuttings bearing the organic material to a heat transfer zone. Large quantities of relatively warm fixed gas are supplied to the heat transfer zone, with the gas functioning as a heat transfer medium. The gas is mixed with the drill cuttings to vaporize water and pollution causing organic material therefrom, with the temperature of the drill cuttings subsequently increasing.

6 Claims, 1 Drawing Figure

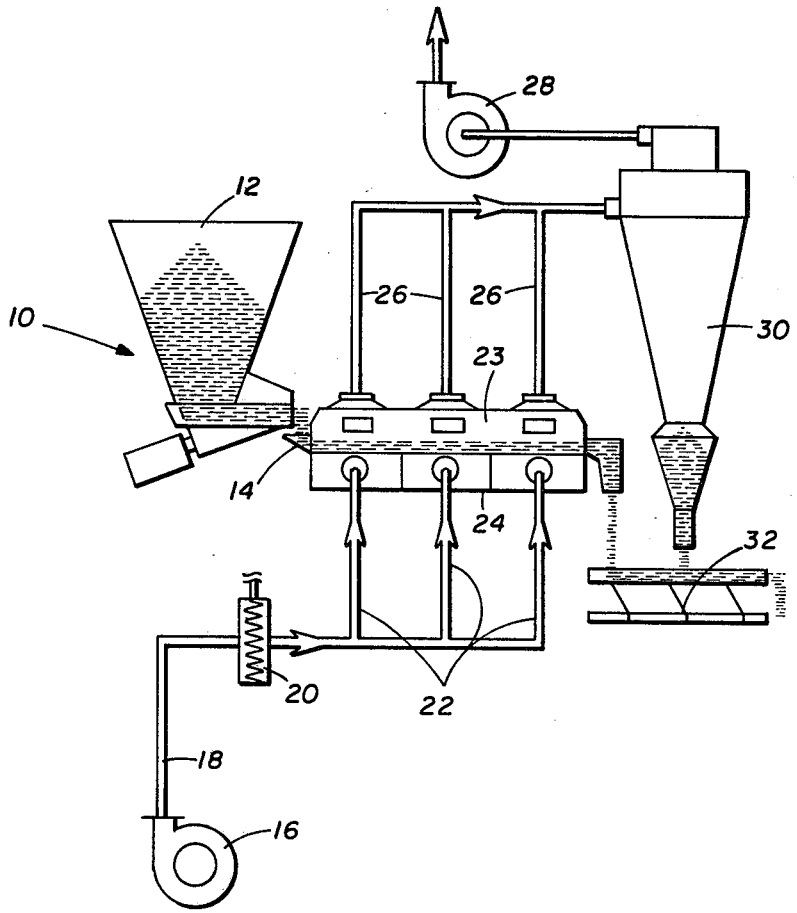
28
12
10
26
26
30
23
14
24
32
20
22
18
16

METHOD FOR DRYING OIL WELL DRILL CUTTINGS

BACKGROUND OF THE INVENTION

The present invention relates to an on-site method for treating contaminated drill cuttings before disposal and particularly relates to a method for drying the cuttings to eliminate pollution causing organic material from the cuttings to enable the cuttings to be disposed of into the water at an offshore drilling location.

The utilization of an oil base drilling fluid or "mud" in offshore rotary drilling operations has become more desirable with the increased utilization of directional drilling techniques. With an oil base drilling fluid, the cuttings, besides ordinarily containing moisture, are necessarily coated with an adherent film or layer of oily drilling fluid which may penetrate into the interior of each cutting. The cuttings produced as a result of the rotary drilling operation are carried from the bottom of the bore hole via the flow of drilling fluid. Mechanical devices are employed to separate the drill cuttings from the drilling fluid; however, the mechanical separating devices do not effectively separate the oil from the cuttings. Because of pollution of the environment, whether on water or land, the cuttings cannot be permanently discarded until the pollutants have been removed therefrom.

There are two general techniques which have heretofor been employed for treating the contaminated cuttings in an attempt to make such cuttings ecologically acceptable. The first such technique involves hauling the cuttings from an offshore drilling site to disposal facilities on shore. The added expense involved in hauling the cuttings ashore is substantial, and accordingly, seriously detracts from wide spread commercial application of this technique. Further, this technique may become impractical in bad weather and/or rough seas as for example, which normally occur in the North Sea during the winter months.

The second technique involves treating and disposing of the drill cuttings directly at the offshore drilling site. For obvious reasons, this technique is much preferred to the technique previously described. Numerous systems have been proposed for treating the drill cuttings at offshore drilling sites. However, each of the prior art systems have suffered from one or more deficiencies which have prevented these systems from becoming commercially acceptable.

One of the previously considered systems employed high intensity infrared lamps to thoroughly combust the oil entrained in the cuttings. This approach was considered unsafe due to possible fire hazards resulting from usage of the high intensity lamps.

A second prior system involved washing the cuttings with a detergent to remove the contaminates, separating the washing solution and contaminates from the cuttings and thereafter dumping the clean cuttings into the water. Although the cuttings were cleaned by this system, the system again proved impractical from a commercial standpoint since a new polluting agent was created i.e. the used detergent itself, which had to be properly handled otherwise ecological damage would result from improper disposal.

Another system proposed volatilizing all the entrained hydrocarbons by passing the drill cuttings in heat transfer relation with very hot fluid. Due to problems associated with oxidation at the relatively high heat transfer temperature i.e. approximately 600° F. or higher, and because of the threat of explosion, an inert atmosphere was required in the heat transfer zone.

Yet another system proposed utilizing jets to spray the cuttings with steam to heat the cuttings to a temperature above the boiling point of water, resulting in vaporization of moisture plus distillation of the organic material entrained in the cuttings. Such system is very inefficient as the energy required to convert water into steam is wasted energy. Further, as the steam is employed to both evaporate water entrained in the cuttings plus vaporize the oil, the steam very readily approaches its saturation temperature resulting in unwanted condensation of some of the steam. Further, depending upon the quantity of moisture entrained in the cuttings, there may be insufficient supply of steam available to vaporize the organic material after the moisture has been evaporated.

It has recently been recognized that not all hydrocarbons are deleterious to the environment. In particular, it has been found that the light, more volatile hydrocarbons are generally more harmful to marine life and vegetation than are the heavier hydrocarbons. Accordingly, the elimination through combustion or otherwise of all hydrocarbons from the drill cuttings to permit disposal thereof directly into the water surrounding an offshore drilling site is not necessary. Only the light hydrocarbons must be eliminated to permit the cuttings to be disposed of into the water.

SUMMARY OF THE INVENTION

Accordingly it is an object of this invention to dry oil well drill cuttings in an energy efficient and safe manner.

It is a further object of this invention to obtain pollution free cuttings at an offshore drilling site.

It is yet another object of this invention to employ a fixed gas to evaporate entrained oil from drill cuttings to render the cuttings pollution free to permit the cuttings to be disposed of at an offshore drilling site.

It is yet another object of this invention to furnish a fixed gas at a relatively high velocity and a temperature below the ignition point of the entrained organic material to produce a non-hazardous mixture of fixed gas and vaporized volatiles.

It is still another object of the invention to employ a fluidized bed process having a relatively warm temperature fixed gas supplied to a heat transfer zone to eliminate entrained pollution causing organic material from drilling cuttings.

These and other objects of the present invention are obtained in a method for drying oil well drilling cuttings to eliminate pollution causing organic material from the cuttings comprising the steps of conveying the drill cuttings bearing the organic material to a heat transfer zone; supplying large quantities of relatively warm fixed gas acting as a heat transfer medium to the heat transfer zone; and directly intermixing the gas with the drill cuttings to vaporize water and pollution causing organic material from the drill cuttings and subsequently increase the temperature of said cuttings.

BRIEF DESCRIPTION OF THE DRAWING

The single FIGURE schematically illustrates a preferred embodiment of the present invention.

DESCRIPTION OF THE PREFERRED EMBODIMENT

Referring now to the drawing, there is disclosed a preferred embodiment of the present invention. In particular, there is disclosed a process for eliminating pollution causing organic material from drill cuttings to enable the drill cuttings to be disposed of directly into the water surrounding an offshore drilling location. The invention may also be employed on land-based drilling equipment to prevent ecological damage to the earth.

Generally, a conventional drilling derrick with its associated drill works, is mounted on a work platform for drilling a well into the earth formations lying beneath the ocean floor. A drill pipe having a drill bit at the lower end, is connected to a rotary table and draw works associated with the derrick. A mud pit is connected by way of a mud line and mud pump to a mud hose and swivel such that the drilling mud is pumped into the top of the drill pipe down through the length thereof and into the bottom of the borehole through the drill bit. A portion of the borehole is cased with a cement sheath.

During the drilling operation, the mud is pumped down through the drill pipe and into the bottom of the borehole. Further pumping of the mud causes it to be pumped up, through the annulus formed between the casing and drill pipe, and into a mud return pipe. As the drill bit cuts into the earth, the drill cuttings or portions of the rock and earth are carried back to the earth's surface via the mud.

At offshore drilling locations, particularly where directional drilling techniques are employed, the mud is oil based. Since the mud is used as the transport medium for bringing the drill cuttings to the surface of the borehole, some of the oil from the mud will be entrained in the drill cuttings and adhere to the surface thereof. The drill cuttings themselves are normally in the form of a slurry, since there is a substantial amount of moisture in the earth cut by the drill bit.

When the mud and entrained drill cuttings are discharged from the mud return line, the combined mud and drill cuttings are generally pumped to a storage or feed tank for processing. Generally, screens and/or shale shakers are employed to separate the oil coated, damp, raw cuttings from the mud. After the initial mechanical separation, the drill cuttings may then be supplied to a washing screen having a continuous spray of a diesel oil solvent mixture furnished thereto to remove the oil mud adhering to the cuttings. Further, other forms of mechanical means such as centrifugal separators, may be employed to separate the cuttings from the mud. However, after all the mechanical and washing processes have been employed, the drill cuttings still have oil entrained therewith. As has been previously discussed, it is necessary to remove at least the light hydrocarbons from the drill cuttings prior to disposal of the cuttings into the water surrounding the drilling site. If the light hydrocarbons are not removed from the drill cuttings, the drill cuttings will cause environmental pollution if directly disposed of into the surrounding water. The present invention provides a process for effectively and efficiently eliminating pollution causing organic material from the drill cuttings.

Process 10 of the present invention includes a feed hopper 12 into which the mechanically clean and washed drill cuttings are conveyed. The cuttings fall by gravity onto a conveying section 14 which preferably comprises an endless chain formed by interconnected screen panels.

A fan 16 delivers a fixed gas, for example air, through a conduit 18 to a heat exchanger 20 functioning as an air heater. The temperature of the air is increased through operation of the air heater. Essentially, the air heater may utilize electricity, hot gas, steam, or other suitable means to increase the temperature of the air passing therethrough. The temperature of the air will be raised to approximately 500° to 550° F. through operation of air heater 20.

As used herein the term "fixed gas" refers to a fluid which is in a gaseous state at standard ambient temperature and pressure conditions. A fixed gas should be contrasted to steam, which at standard conditions, is in its liquid phase. Although the process shall be described hereinafter as utilizing air, it should be understood other fixed gases may also be employed, such gases including nitrogen, carbon dioxide, and exhaust gases from internal combustion engines.

The relatively warm air is discharged from the air heater into conduits 22. The air thence passes through the conduits into a heat transfer zone 23 formed in dryer 24. Preferably, dryer 24 is a vibrating bed dryer to achieve efficient operation of the present invention. Conveyor section 14 delivers the drill cuttings through zone 23. The air passes upwardly through the screen panels and then through the drill cuttings disposed thereon. The passage of the air at a relatively high velocity, for example 300 feet per minute, plus vibration of the conveying section, through suitable means not shown results in fluidization of the drill cuttings. Essentially, the individual particles of drill cuttings are entrained within the flowing air stream. Each particle is completely surrounded by the flowing gas to maximize heat transfer from the gas to the drill cutting particles. Heat from the gas is imparted to the drill cuttings causing moisture and relatively light hydrocarbons to be vaporized and the temperature of the cuttings to be increased.

The warm temperature gas, passing through heat transfer zone 23 is discharged via conduits 26 into a dust collector 30 or similar device. The air has the vaporized hydrocarbons and moisture entrained therewith. The gas passes from the dust collector 30 via an exhaust fan 28 and may thence be delivered to a condenser or similar apparatus if recovery of the entrained vaporous organic material is desired or necessary. The relatively clean drill cuttings pass from zone 23 of drying section 24 onto a flatbed 32 from whence the cuttings may be directly disposed of into the surrounding water. The clean cuttings may still have heavier hydrocarbons entrained therewith; however as has been recently recognized, these hydrocarbons are not ecologically harmful.

The passage of the warm gas through heat transfer zone 23 results in two stages of vaporization of the moisture and entrained hydrocarbons from the drill cuttings. Essentially, the fixed gas is very dry and since it is at a relatively warm temperature, its capacity to absorb moisture from the drill cuttings is extremely high. As the warm temperature gas flows into contact with the fluidized drill cutting particles, the moisture and relatively light hydrocarbons adhering to the surface of the drill cuttings are vaporized therefrom at a constant rate. As all the moisture and light hydrocarbons are vaporized from the surface of the drill cuttings any moisture and hydrocarbons contained in the drill cuttings below the surface thereof will diffuse to the exterior surface and thence be vaporized by transfer of heat from the gas stream. During this latter stage, since less heat is required to vaporize the moisture and hydrocarbons, the sensible temperature of the cuttings is increased.

By utilizing the foregoing process, the individual particles of drill cuttings are separated and suspended in the gas, resulting in maximum heat transfer between the gas stream and suspended particles. Further, the present process employs a heated fixed gas directly as a heat transfer medium, resulting in direct transfer of heat from the medium to the cuttings. Further, since a relatively high flow rate of the gas stream through the heat transfer zone is maintained, for example approximately 300 feet per minute, the removal of moisture and entrained organics from the drill cuttings occurs at a relatively fast rate. In effect, vaporization of the more volatile organics from the drill cuttings will occur at a high rate with a relatively low level of heat input to the fixed gas stream.

As the temperature of the air will be increased only to 500° to 550° F., the temperature of the drill cuttings will be maintained below the ignition point of the hydrocarbons. The foregoing will enable air to be safely employed without risking combustion of the hydrocarbons. To further increase the safety of the process, a high volume of air flow is maintained resulting in the mixture of air-vaporous organic material being diluted whereby the mixture contains less than 1% organic material. This again will insure that combustion will not be possible with the entrained organics.

Although there are a number of dryers which may be commercially employed in the process of the invention, one such dryer is manufactured by the Jeffrey Manufacturing division of Dresser Industries, Inc. and is illustrated in "Jeffrey" catalog 1149-3.5 entitled "Dryers and Coolers."

The above described process provides an efficient and effective means for eliminating pollution causing hydrocarbons from drill cuttings permitting the subsequent disposal thereof into water surrounding an offshore drilling site.

While a preferred embodiment of the present invention has been described and illustrated, the invention should not be limited thereto but may be otherwise embodied within the scope of the following claims.

The embodiments of the invention in which an exclusive property or privilege is claimed are defined as follows:

1. A method for drying oil well drill cuttings to eliminate pollution causing volatile organic material including hyrocarbons from the cuttings comprising the steps of:

conveying the drill cuttings bearing the organic material to a heat transfer zone;

pre-heating large quantities of relatively warm combustion supporting gas acting as a heat transfer medium to a temperature less than the ignition point of said hydrocarbons;

supplying large quantities of the relatively warm gas to the heat transfer zone to form a diluted gas-organic material mixture to prevent the formation of a combustible mixture; and directly mixing the gas with the drill cuttings to rapidly vaporize water and pollution causing volatile organic material from the drill cuttings and subsequently increase the temperature of the cuttings.

2. A method in accordance with claim 1 wherein:

the conveying step includes vibrating the drill cuttings; and the supplying step includes delivering the gas at a substantially high velocity whereby individual particles of drill cuttings are fluidized upon intermixing with the relatively warm temperature high velocity fixed gas.

3. A method in accordance with claims 1 or 2 wherein the gas is air.

4. A method for drying oil well drill cuttings to eliminate pollution causing organic material including hydrocarbons from the cuttings comprising the steps of:

conveying the drill cuttings bearing the organic material to a heat transfer zone;

vibrating the cuttings in the heat transfer zone;

pre-heating large quantities of relatively warm air acting as heat transfer medium to a temperature less than the ignition point of said hydrocarbons;

supplying large quantities of the relatively warm temperature air at a high velocity to the heat transfer zone to form a diluted gas-organic material mixture to prevent the formation of a combustible mixture; and directly intermixing the air with the drill cuttings whereby water and pollution causing organic material are vaporized and thereafter entrained in the air stream exiting from the heat transfer zone.

5. A method in accordance with claim 4 wherein the temperature of the air is maintained below the ignition temperature of the entrained organics to prevent ignition of the air-vaporous organic material mixture.

6. A method in accordance with claim 4 wherein the quantity of air supplied to the heat transfer zone is of a relatively large magnitude to dilute the air-vaporous organic material mixture to prevent an explosive mixture from being formed.

* * * * *